US006655239B1

(12) United States Patent
Macor

(10) Patent No.: US 6,655,239 B1
(45) Date of Patent: Dec. 2, 2003

(54) DOUBLE-ENDED WRENCH WITH ERGONOMIC HANDLE

(76) Inventor: Richard J. Macor, 26 Alpaugh Dr., Asbury, NJ (US) 08802-1213

( * ) Notice: Subject to any disclaimer, the term of this patent is extended or adjusted under 35 U.S.C. 154(b) by 0 days.

(21) Appl. No.: 10/226,055

(22) Filed: Aug. 22, 2002

(51) Int. Cl.[7] ..... B25B 13/02
(52) U.S. Cl. ..... 81/125.1; 81/124.3; 81/177.1
(58) Field of Search ..... 81/124.3, 124.4, 81/177.1, 125.1

(56) References Cited

U.S. PATENT DOCUMENTS

| | | | | |
|---|---|---|---|---|
| 1,659,015 A | * | 2/1928 | Breed | 81/125.1 |
| 1,793,714 A | | 2/1931 | Newberg | |
| 1,811,137 A | * | 6/1931 | Kress | 81/124.3 |
| 4,084,456 A | * | 4/1978 | Pasbrig | 81/177.8 |
| 5,172,614 A | | 12/1992 | Monnet et al. | |
| 5,865,074 A | * | 2/1999 | Hsieh | 81/124.3 |
| D434,292 S | | 11/2000 | Hsieh | |

* cited by examiner

*Primary Examiner*—D. S. Meislin

(57) ABSTRACT

A double-ended wrench is described having an elongated handle formed substantially nontwisted extending in a longitudinal direction, a first wrench head positioned at one end of the wrench and a second wrench head positioned at the other end thereof. Each wrench head has an orifice with an imaginary axis of wrench rotation. The first wrench head is positioned relative to the second wrench head whereas the axis of wrench rotation of the first wrench head is substantially perpendicular to the axis of wrench rotation of the second wrench head. The elongated handle comprises a first handle portion connecting to the first wrench head, and a second handle portion connecting to the second wrench head. Each handle portion has an elongated cross-sectional shape when viewed in a cross-sectional plane perpendicular to the longitudinal direction. Each cross-sectional shape is elongated in a predetermined direction, and, the first handle portion is positioned relative to the second handle portion whereas the cross-sectional shape of the first handle portion is elongated in a direction substantially perpendicular to the direction in which the cross-sectional shape of the second handle portion is elongated.

21 Claims, 3 Drawing Sheets

DOUBLE-ENDED WRENCH WITH ERGONOMIC HANDLE

FIELD OF THE INVENTION

The present invention relates to hand tools, particularly hand operated double-ended wrenches including combination wrenches, box wrenches, open end wrenches, flex head wrenches and the like.

BACKGROUND OF THE INVENTION

Hand operated double-ended wrenches have been around for many years and they are typically structured having an elongated, flat shaped handle with a wrench head at each end for turning various fasteners. Typical variations include combination, double box, double open-end, flex-head type and the like. The flat shaped handle connected to each wrench head provides each wrench head with excellent accessibility to fasteners. It is, however, the flat shaped handle that creates a major disadvantage associated with this tool. The elongated, flat handle provides only a thin surface area for the application of force by a user to turn and operate the wrench. This minimal surface area creates user discomfort and fatigue, while limiting torque and continuous-use capabilities.

More recently, there have been attempts to improve the double-ended wrench by simply distorting or twisting the handle of the older prior art wrench. This twisted handle configuration does provide some advantages including a greater surface area for the application of force by a user at each end of the wrench. However, the distorted or twisted handle also creates new problems including a reduction in strength and torque capacity, and a reduction in accessibility to fasteners under some conditions. In addition, the distorted shape of the wrench handle may feel awkward and appear damaged or bent to a user.

Accordingly, there is a significant need to improve upon the typical prior art, double-ended wrenches. The improvements contemplated would provide a user with less fatigue, improved comfort and torque capabilities. While contemplating such improvements, however, it is important not to sacrifice the inherent good features of the wrench which include its two wrench heads and excellent accessibility to fasteners.

SUMMARY OF THE INVENTION

The present invention involves a double-ended wrench comprising an elongated handle formed substantially non-twisted extending in a longitudinal direction, a first wrench head positioned at one end of the wrench and a second wrench head positioned at the other end thereof. Each wrench head has an orifice with an imaginary axis of wrench rotation. The first wrench head is positioned relative to the second wrench head whereas the axis of wrench rotation of the first wrench head is substantially perpendicular to the axis of wrench rotation of the second wrench head. The elongated handle comprises a first handle portion connecting to the first wrench head, and a second handle portion connecting to the second wrench head. Each handle portion has an elongated cross-sectional shape when viewed in a cross-sectional plane perpendicular to the longitudinal direction. Each cross-sectional shape is elongated in a predetermined direction, and, the first handle portion is positioned relative to the second handle portion whereas the cross-sectional shape of the first handle portion is elongated in a direction substantially perpendicular to the direction in which the cross-sectional shape of the second handle portion is elongated.

Applicant recognizes the need for an improved double-ended wrench, one which provides a user with less fatigue, improved comfort and torque capabilities. While contemplating such improvements, applicant further recognizes the importance of not sacrificing the inherent good features of the typical double-ended wrench which include its two wrench heads and excellent accessibility to fasteners.

Accordingly, it is an important objective of the present invention described above, that it have two wrench heads.

It is another important objective of the present invention described above, that it be structured for excellent accessibility to fasteners.

It is another important objective of the present invention described above, that it be structured to reduce fatigue, improve comfort and torque capabilities.

It is another important objective of the present invention described above, that it be undistorted and simple in design for strength, durability and user acceptance.

And, it is yet another important objective of the present invention described above, that it be cost efficient to manufacture and commercially viable.

DETAILED DESCRIPTION OF THE DRAWINGS

Figure 1:
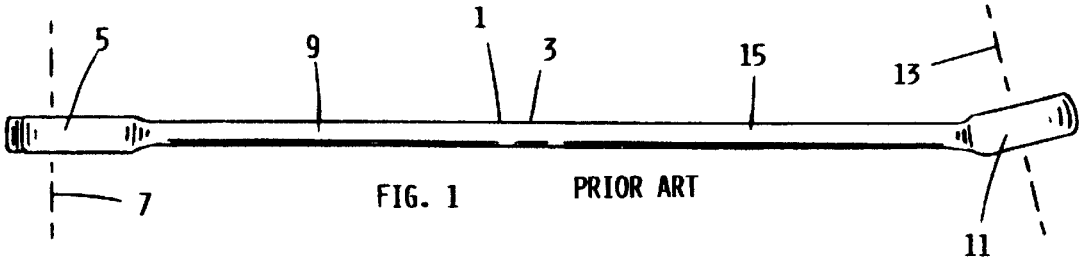
FIG. 1 PRIOR ART
FIG. 1 shows a left side, elevational view of a typical prior art double-ended wrench; and, FIG. 2 shows a top plan view of the prior art wrench shown in FIG. 1; and, FIG. 3 shows a left side, elevational view of a present invention double-ended wrench; and, FIG. 4 shows a top plan view of the present invention wrench shown in FIG. 3; and, FIG. 5 shows an end view of the present invention wrench shown in FIGS. 3 and 4; and, FIG. 6 shows a cross-sectional, end view of the first handle portion of the present invention wrench shown in FIG. 3; and, FIG. 7 shows a cross-sectional, end view of the second handle portion of the present invention wrench shown in FIG. 3; and, FIG. 8 shows a perspective view of another present invention double-ended wrench; and, FIG. 9 shows a left side, elevational view of another present invention wrench with each wrench head being pivotably connected to a wrench handle portion, and one wrench head further having a ratcheting mechanism.

Referring now to the drawings which are for the purpose of illustrating preferred embodiments of the present invention and not for the purpose of limiting same, FIG. 1 shows a left side, elevational view of a typical prior art double-ended wrench. Prior art wrench 1 has an elongated wrench handle 3 and a two wrench heads 5 and 11. Open end wrench head 5 has an imaginary central axis 7 which is the axis of wrench rotation for wrench head 5, and, wrench head 11 has an imaginary central axis 13 which is the axis of wrench rotation for wrench head 11. Wrench head 5 is connected to handle portion 9, and, wrench head 11 is connected to handle portion 15. When operating wrench 1, a user will generally grip handle portion 15 to turn wrench head 5 about imaginary central axis 7 to turn various fasteners. Alternatively, a user will generally grip handle portion 9 to turn wrench head 11 about imaginary central axis 13 to turn various fasteners. Wrench handle portion 9 is relatively thin as seen in this side view so that wrench head 5 can easily access and engage a fastener located in common or limited-access environments. Likewise, wrench handle portion 15 is relatively thin as seen in this side view so that wrench head 13 can easily access and engage with fasteners located in common and limited-access environments. Consequently, wrench handle portion 9 provides only a minimal surface area for the application of force by a user to turn and operate wrench head 11, and, handle portion 15 provides only a minimal surface area for the application of force by a user to turn and operate wrench head 5. This minimal surface area promotes user discomfort and fatigue, while limiting torque and continuous-use capabilities.

Figure 2:
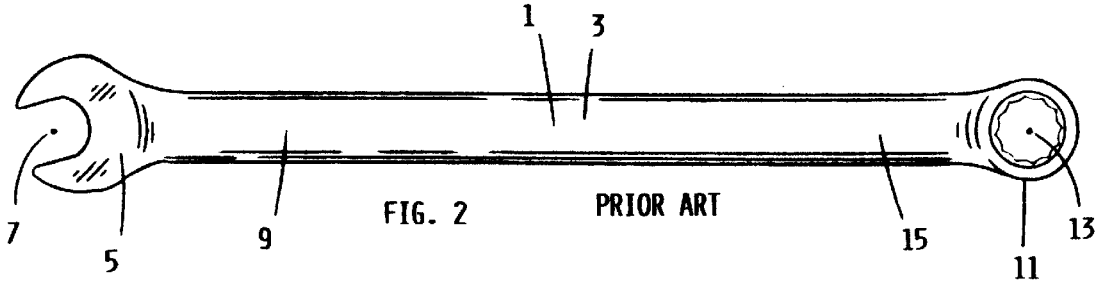
FIG. 2 PRIOR ART

FIG. 2 shows a top plan view of the prior art wrench shown in FIG. 1 with all visible components having the same reference numbers.

Referring now to both FIGS. 1 and 2 together, if wrench 1 were to be viewed from an end view (not shown), it is easy to comprehend that the imaginary central axis 7 of wrench head 5 would be substantially parallel to the imaginary central axis 13 of wrench head 11. And, if wrench 1 were to be viewed from an end view thereof, it is easy to comprehend that first handle portion 9 and second handle portion 15 would each have an elongated cross-sectional shape, with the elongation of each handle portion shape positioned substantially parallel and aligned to the other. And, the side surface of handle 3 (including handle portions 9 and 15) shown in FIG. 1, is not tapered at all or in either direction, but is formed with substantially parallel sides as shown. And, the top surface of handle 3 (including handle portions 9 and 15) shown in FIG. 2, is not tapered at all in either direction, but is formed with substantially parallel sides as shown.

More recently, there have been attempts to improve the prior art wrench shown in FIGS. 1 and 2, by simply distorting or twisting the handle ninety degrees relative to a longitudinal axis. Structural features of such a wrench include a side handle surface which is not tapered in either direction and which does not extend in a longitudinal direction, but rather, wraps around the wrench handle in a direction other than longitudinal. Additionally, such wrench includes an upper handle surface which is not tapered in either direction and which does not extend in a longitudinal direction, but rather, wraps around the wrench handle in a direction other than longitudinal. It is important to understand that the side and upper surfaces of such a twisted handle are in fact, twisted, not tapered. Accordingly, a twisted wrench handle does not have a side or upper "surface" which is substantially "continuous" as defined herein, nor does it have a side or upper "surface" which is "common" to both ends of the wrench handle, as defined herein. Such a "distorted" wrench as defined herein, creates new problems including a reduction in strength and torque capacity, and a reduction in accessibility to fasteners under some conditions. In addition, a distorted wrench handle may feel awkward and appear damaged or bent to a user. A "tapering" wrench surface shall be defined herein as a wrench surface that decreases in width or thickness.

Accordingly, there is a significant need for an improved double-ended wrench, one which provides a user with less fatigue, improved comfort and torque capabilities, without sacrificing wrench strength or accessibility to fasteners.

Applicant defines a "distorted" wrench herein as being a wrench that is twisted in shape. An "undistorted" wrench, therefore, shall be defined as a wrench which is not distorted II,II or twisted in shape. A wrench "surface" shall be defined herein as the exterior of a wrench, or the exterior of a specified part of a wrench. A "continuous" wrench surface shall be defined herein as a wrench surface going on without any substantial interruption, or being unbroken. A "common" wrench surface shall be defined herein as a wrench surface which belongs to, or is shared by, two or more specified parts of the wrench.

Figure 3:
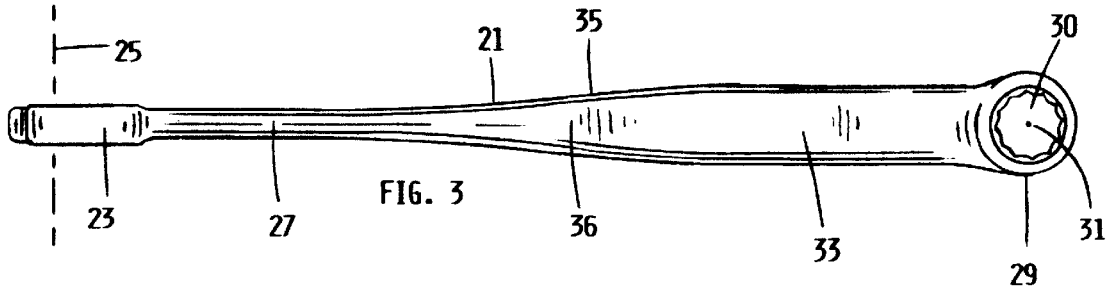
Figure 4:
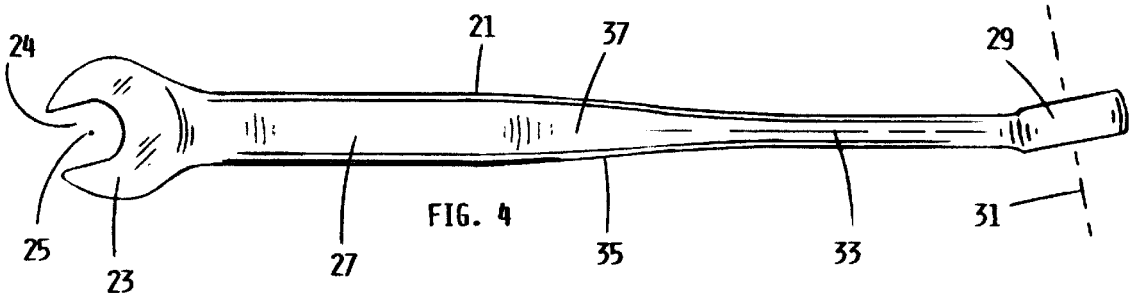
Figure 5:
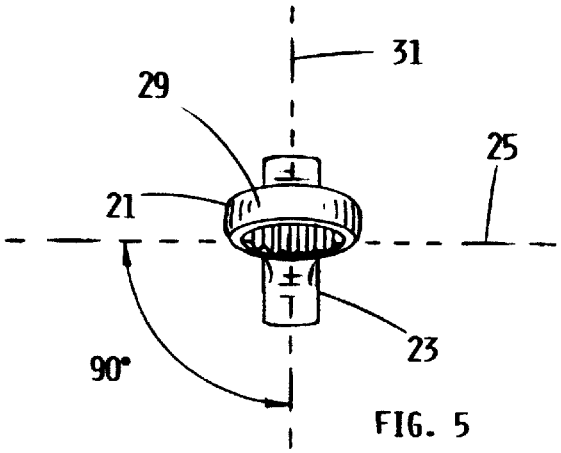

Referring to FIGS. 3, 4 and 5 together, there is shown a present invention double-ended wrench shown in a left side elevational view, a top plan view, and an end view respectively. Wrench 21 is a one piece, double-ended wrench comprising a first wrench head 23 positioned at one end of an elongated handle 35 and a second wrench head 29 positioned at the other end thereof. Wrench head 23 has an orifice 24 formed for engagement with various fasteners, and wrench head 29 has an orifice 30 formed for engagement with various fasteners. Orifice 24 has an imaginary central axis of wrench rotation 25, and orifice 30 has an imaginary central axis of wrench rotation 31. First wrench head 23 is positioned relative to the second wrench head 29 whereas the axis of wrench rotation 25 of the first wrench head 23 is substantially perpendicular to the axis of wrench rotation 31 of the second wrench head 29 (seen best in FIG. 5.) The elongated handle 35 is formed undistorted, and comprises a first handle portion 27 connecting to the first wrench head 23, and a second handle portion 33 connecting to the second wrench head 29. When the wrench 21 is viewed from an end view thereof, the first and second handle portions 27 and 33 respectively, each have an elongated cross-sectional shape with the elongated cross-sectional shape of the first handle portion 27 being positioned substantially perpendicular to the axis of wrench rotation 25 of the first wrench head 23, and substantially parallel to the axis of wrench rotation 31 of the second wrench head 29 (seen best in FIG. 6). And, the elongated, cross-sectional shape of the second handle portion 33 is positioned substantially perpendicular to the axis of wrench rotation 31 of the second wrench head 29, and substantially parallel to the axis of wrench rotation 25 of the first wrench head 23 (seen best in FIG. 7). By positioning the handle portions to the wrench heads as shown, the wrench maintains an excellent accessibility to fasteners located in common and limited-access environments. The undistorted, elongated handle 35 further comprises a side surface 36 (seen best in FIG. 3) extending in a longitudinal direction and tapering towards the first wrench head 23 as shown. Elongated handle 35 also comprises an upper surface 37 (seen best in FIG. 4) extending in a longitudinal direction tapering towards the second wrench head 29 as shown. To operate wrench 21, a user will generally grip handle portion 33 to turn wrench head 23 around the axis of wrench rotation 25 (seen best in FIG. 3), and alternatively, a user may grip handle portion 27 to turn wrench head 29 around the axis of wrench rotation 31 (seen best in FIG. 4). Accordingly, the side and upper surfaces of the wrench are tapered as shown to achieve a more substantial surface area for the application of force by a user to turn the wrench, while simultaneously, maintaining excellent wrench-to-fastener accessibility around the wrench head being turned. Additionally, tapered side surface 36 shown in FIG. 3 is formed being substantially continuous and common to both the first and second handle portions 27 and 33 respectively. Likewise, tapered upper surface 37 shown in FIG. 4 is formed being substantially continuous and common to both the first and second handle portions 27 and 33 respectively. The present invention wrench disclosed and shown here, has structural features which are substantially and significantly different than the prior art wrenches disclosed herein.

Figure 6:
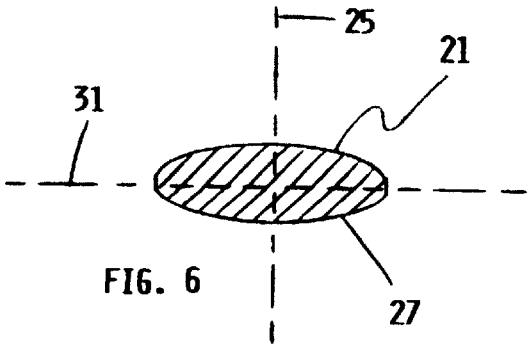
Figure 7:
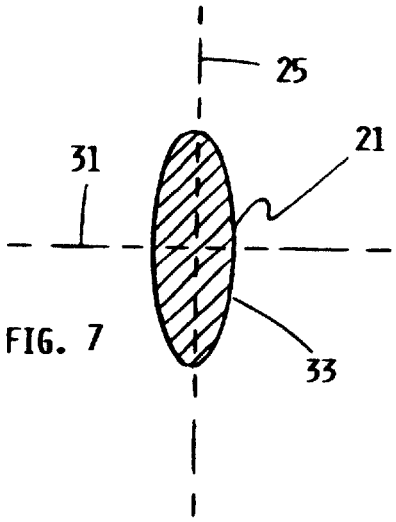

Referring now to FIGS. 6 and 7 together, FIG. 6 shows a cross-sectional, end view of the first handle portion 27 of the present invention wrench 21 shown in FIG. 3. FIG. 7 shows a cross-sectional, end view of the second handle portion 33 of the present invention wrench 21 shown in FIG. 3. When the wrench 21 is viewed from an end view thereof, the first and second handle portions 27 and 33 respectively, each have an elongated cross-sectional shape. Each cross-sectional shape is elongated in a distinct directions shown, and therefore, the direction of elongation may be used to compare the orientation of one handle portion to another or to an axis of wrench rotation. The elongated cross-sectional shape of the first handle portion 27 is positioned substantially perpendicular to the axis of wrench rotation 25 of the first wrench head, and substantially parallel to the axis of wrench rotation 31 of the second wrench head. And, the elongated cross-sectional shape of the second handle portion 33 is positioned substantially perpendicular to the axis of wrench rotation 31 of the second wrench head, and substantially parallel to the axis of wrench rotation 25 of the first wrench head. By positioning the handle portions to the wrench heads as shown, the wrench maintains an excellent accessibility to fasteners located in common and limited-access environments.

Figure 8:
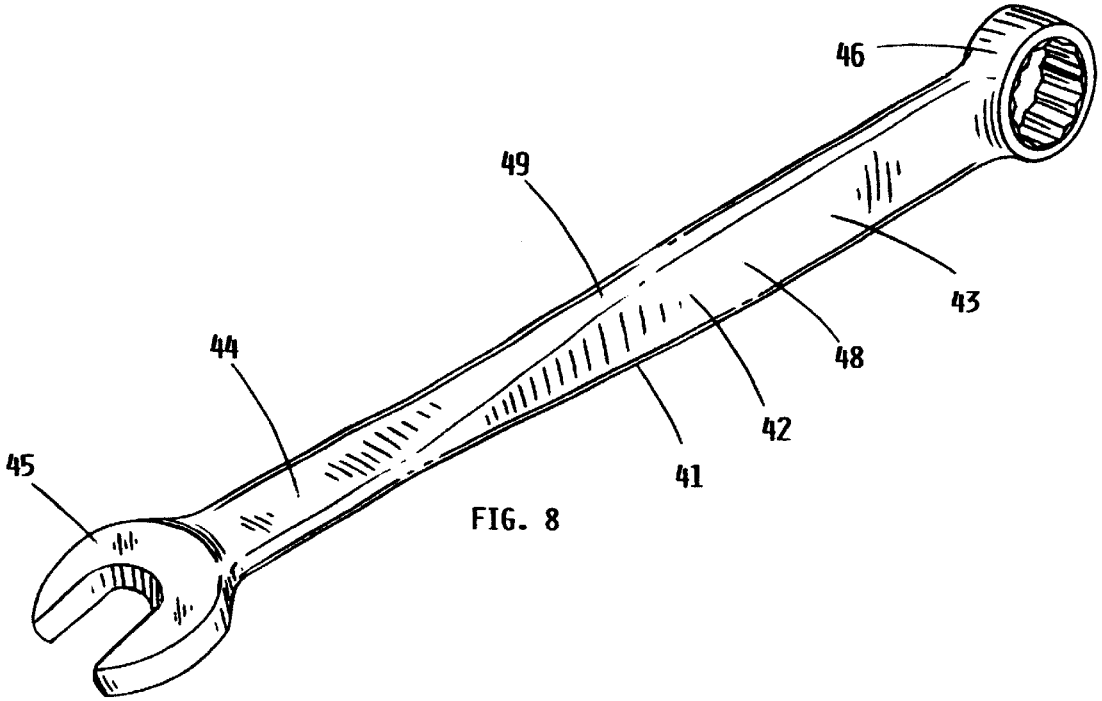

FIG. 8 shows a perspective view of another present invention double-ended wrench, whereas, double-ended wrench 41 has an undistorted, elongated handle 42, comprising a first handle portion 44 and a second handle portion 43. First handle portion 44 is connected to a first wrench head 45, and, second handle portion 43 is connected to a second wrench head 46 as shown. It can be seen that elongated handle 42 has a side surface 48 extending in a longitudinal direction tapering towards the first wrench head 45, and, an upper surface 49 extending in a longitudinal direction tapering towards the second wrench head 46. Also, tapering side surface 48 is formed substantially continuous and common to both the first and second handle portions 44 and 43 respectively, and, the tapered upper surface 49 is formed substantially continuous and common to both the first and second handle portions 44 and 43 respectively.

Figure 9:
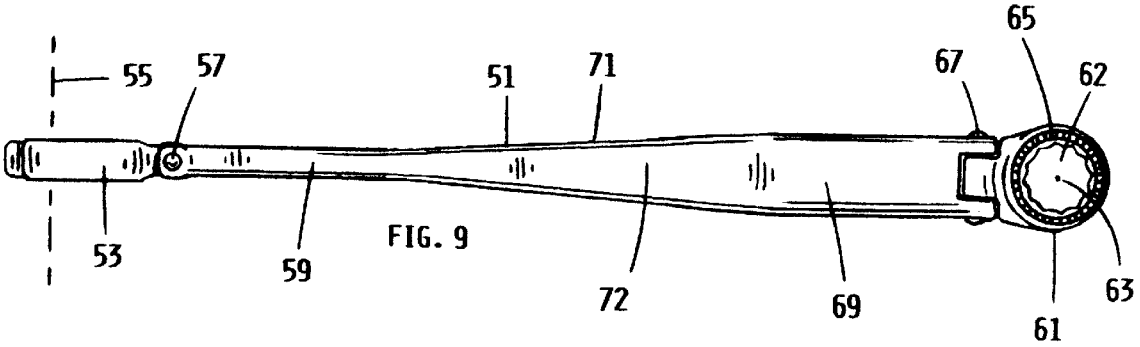

FIG. 9 shows a left side, elevational view of another present invention, combination wrench with each wrench head being pivotably connected to a wrench handle portion, and one wrench head further having a ratcheting mechanism. A double-ended wrench 51 is shown comprising a first wrench head 53 positioned at one end of an elongated handle 71 and a second wrench head 61 positioned at the other end thereof. Wrench head 61 contains a ratcheting mechanism 65 therein to expedite the wrenching process of wrench 51. Each wrench head has an orifice formed for engagement with various fasteners, with orifice 62 of wrench head 61 seen in this view. Each orifice has an imaginary central axis of wrench rotation. The first wrench head is positioned relative to the second wrench head whereas the axis of wrench rotation 55 of the first wrench head 53 is substantially perpendicular to the axis of wrench rotation 63 of the second wrench head 61. The elongated handle 71 is formed substantially undistorted, and comprises a first handle portion 59 pivotably connecting to the first wrench head 53 with pivot axle 57, and a second handle portion 69 pivotably connecting to the second wrench head 61 with pivot axle 67. The first and second handle portions 59 and 69 respectively, each have an elongated cross-sectional shape when the wrench is viewed from an end view thereof. The undistorted, elongated handle 71 further comprises a side surface 72 extending in a longitudinal direction tapering towards the first wrench head 53, and an upper surface (not seen in this view) extending in a longitudinal direction tapering towards the second wrench head 61. The present invention, double-ended wrench may have two wrench heads which are the same type, or, two wrench heads which are different in type. Each wrench head may be fixed or pivotably connected to a handle portion of the wrench. Other embodiments of the present invention may include a ratcheting mechanism contained in one or both wrench heads to expedite the wrenching process.

When considering the present invention, simplicity and obviousness should not be confused or considered the same. Accordingly, the novelty and complexity of the present invention must be measured by the many interrelated objectives set forth herein, including accessibility, comfort, torque, strength, durability and ergonomic considerations.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A double-ended wrench comprising an elongated handle formed substantially nontwisted extending in a longitudinal direction, a first wrench head positioned at one end of said wrench and a second wrench head positioned at the other end thereof, each said wrench head having an orifice with an imaginary axis of wrench rotation, said first wrench head being positioned relative to said second wrench head whereas the axis of wrench rotation of said first wrench head is substantially perpendicular to the axis of wrench rotation of said second wrench head, said nontwisted elongated handle comprising a first handle portion connecting to said first wrench head, and a second handle portion connecting to said second wrench head, each said handle portion having an elongated cross-sectional shape when viewed in a cross-sectional plane perpendicular to said longitudinal direction, each said cross-sectional shape being elongated in a predetermined direction, and, said first handle portion being positioned relative to said second handle portion whereas the cross-sectional shape of said first handle portion is elongated in a direction substantially perpendicular to the direction in which the cross-sectional shape of said second handle portion is elongated.

2. A double-ended wrench of claim 1, wherein said nontwisted elongated handle further comprises a side surface extending in a longitudinal direction tapering towards said first wrench head, and an upper surface extending in a longitudinal direction tapering towards said second wrench head.

3. A double-ended wrench of claim 1, wherein said first wrench head is a different type of wrench head than said second wrench head.

4. A double-ended wrench of claim 1, wherein both of said wrench heads are the same type of wrench head.

5. A double-ended wrench of claim 1, wherein at least one of said wrench heads includes a ratcheting mechanism.

6. A double-ended wrench of claim 1, wherein at least one of said wrench heads is pivotably connected to a handle portion.

7. A double-ended wrench of claim 2, wherein said first wrench head is a different type of wrench head than said second wrench head.

8. A double-ended wrench of claim 2, wherein both of said wrench heads are the same type of wrench head.

9. A double-ended wrench of claim 2, wherein at least one of said wrench heads includes a ratcheting mechanism.

10. A double-ended wrench of claim 2, wherein at least one of said wrench heads is pivotably connected to a handle portion.

11. A double-ended wrench comprising an elongated handle formed substantially nontwisted extending in a longitudinal direction, a first wrench head positioned at one end of said wrench and a second wrench head positioned at the other end thereof, each said wrench head having an orifice with an imaginary axis of wrench rotation, said first wrench head being positioned relative to said second wrench head whereas the axis of wrench rotation of said first wrench head is substantially perpendicular to the axis of wrench rotation of said second wrench head, said nontwisted elongated handle comprising a first handle portion connecting to said first wrench head, and a second handle portion connecting to said second wrench head, each said handle portion having an elongated cross-sectional shape when viewed in a cross-sectional plane perpendicular to said longitudinal direction, each said cross-sectional shape being elongated in a predetermined direction, said first handle portion being positioned relative to said second handle portion whereas the cross-sectional shape of said first handle portion is elongated in a direction substantially perpendicular to the direction in which the cross-sectional shape of said second handle portion is elongated, and further whereas, the cross-sectional shape of said first handle portion is elongated in a direction substantially perpendicular to the axis of wrench rotation of said first wrench head and substantially parallel to the axis of wrench rotation of said second wrench head, and, the cross-sectional shape of said second handle portion is elongated in a direction substantially perpendicular to the axis of wrench rotation of said second wrench head, and substantially parallel to the axis of wrench rotation of said first wrench head.

12. A double-ended wrench of claim 11, wherein said nontwisted elongated handle further comprises a side surface extending in a longitudinal direction tapering towards said first wrench head, and an upper surface extending in a longitudinal direction tapering towards said second wrench head.

13. A double-ended wrench of claim 11, wherein said first wrench head is a different type of wrench head than said second wrench head.

14. A double-ended wrench of claim 11, wherein both of said wrench heads are the same type of wrench head.

15. A double-ended wrench of claim 11, wherein at least one of said wrench heads includes a ratcheting mechanism.

16. A double-ended wrench of claim 11, wherein at least one of said wrench heads is pivotably connected to a handle portion.

17. A double-ended wrench of claim 12, wherein said tapering side surface is formed substantially continuous and common to both said first and second handle portions, and, said tapering upper surface is formed substantially continuous and common to both said first and second handle portions.

18. A double-ended wrench of claim 12, wherein said first wrench head is a different type of wrench head than said second wrench head.

19. A double-ended wrench of claim 12, wherein both of said wrench heads are the same type of wrench head.

20. A double-ended wrench of claim 12, wherein at least one of said wrench heads includes a ratcheting mechanism.

21. A double-ended wrench of claim 12, wherein at least one of said wrench heads is pivotably connected to a handle portion.

* * * * *